US008692471B2

(12) United States Patent
Seo et al.

(10) Patent No.: US 8,692,471 B2
(45) Date of Patent: Apr. 8, 2014

(54) LED DRIVING SYSTEM AND METHOD

(75) Inventors: Jaegon Seo, Yongin (KR); Sang-O Jeon, Yongin (KR); Hyunick Shin, Seoul (KR)

(73) Assignee: Analog Devices, Inc., Norwood, MA (US)

( * ) Notice: Subject to any disclaimer, the term of this patent is extended or adjusted under 35 U.S.C. 154(b) by 264 days.

(21) Appl. No.: 13/233,638

(22) Filed: Sep. 15, 2011

(65) Prior Publication Data

US 2013/0069545 A1 Mar. 21, 2013

(51) Int. Cl.
*H05B 37/00* (2006.01)

(52) U.S. Cl.
USPC ..... 315/186; 315/224; 315/307

(58) Field of Classification Search
USPC ..... 315/186, 192, 209 R, 224–226, 250, 315/291, 297, 307, 308, 360
See application file for complete search history.

(56) References Cited

U.S. PATENT DOCUMENTS

2008/0088252 A1 4/2008 Chen et al. ..... 315/224
2008/0100232 A1 5/2008 Miguchi ..... 315/294
2008/0316781 A1* 12/2008 Liu ..... 363/80
2009/0189539 A1 7/2009 Deng et al. ..... 315/294
2011/0109249 A1* 5/2011 Liu et al. ..... 315/307
2012/0313545 A1* 12/2012 Courtel ..... 315/250

FOREIGN PATENT DOCUMENTS

WO WO-2013039614 A1 3/2013

OTHER PUBLICATIONS

"International Application Serial No. PCT/US2012/049624, International Search Report mailed Feb. 12, 2013", 5 pgs.

* cited by examiner

*Primary Examiner* — Tung X Le
(74) *Attorney, Agent, or Firm* — Schwegman Lundberg & Woessner, P.A.

(57) ABSTRACT

A LED driving system and method suitable for driving one or more LEDs or strings of LEDs connected to a common output terminal which is driven with a boost converter. A LED ON signal indicates when the LEDs are to be turned on, with the boost converter nominally operated only when the LEDs are to be on. To enable a lower minimum LED duty cycle without risking boost voltage collapse, the LED ON signal may be delayed such that the LEDs are turned on after the boost converter. A second technique, which may be used in conjunction with the first, adaptively extends the operation time of the boost converter beyond the time at which LED ON turns off the LEDs.

19 Claims, 3 Drawing Sheets

FIG. 1a
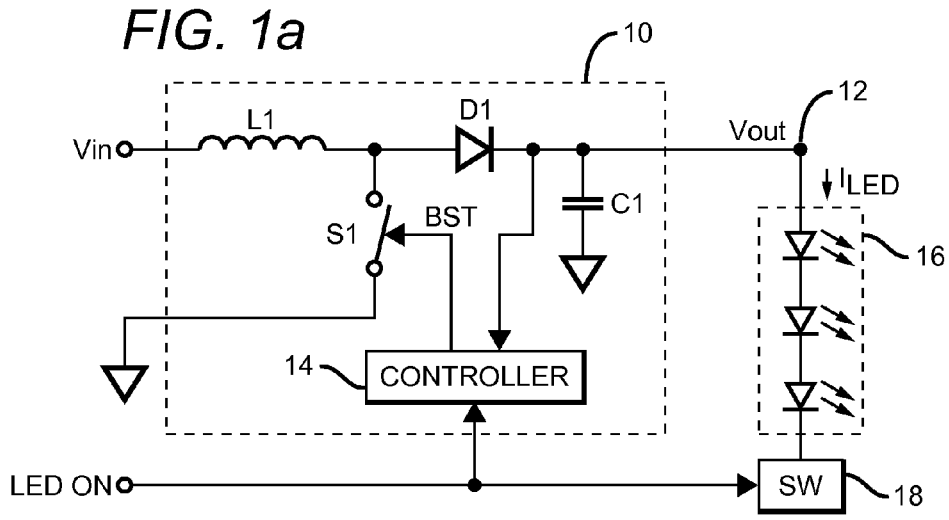
FIG. 1b
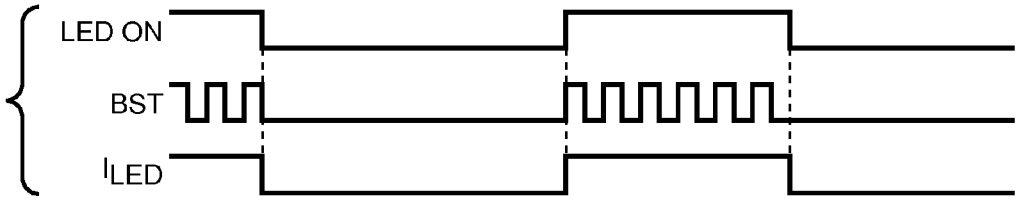
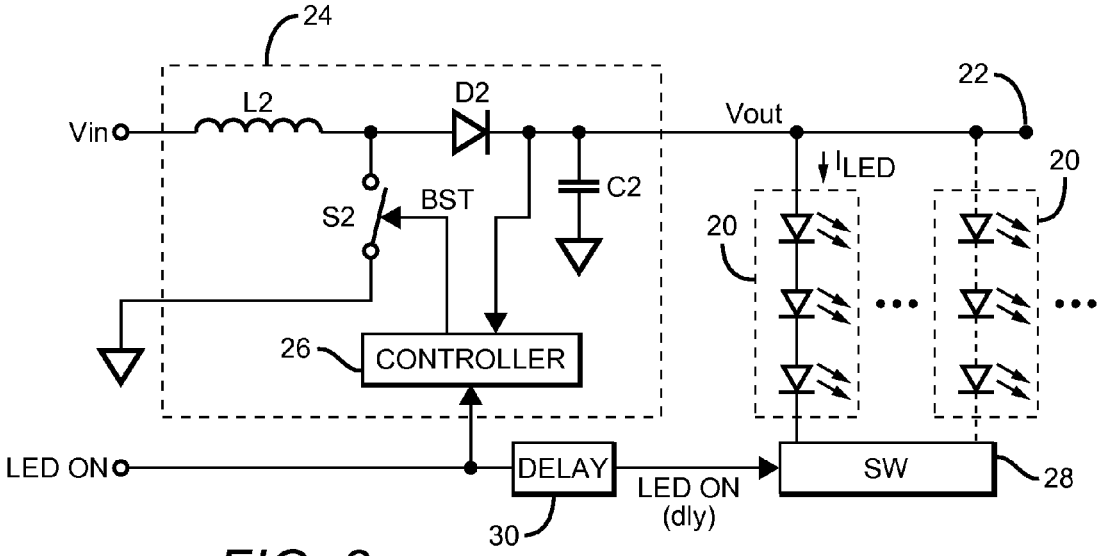
FIG. 2a

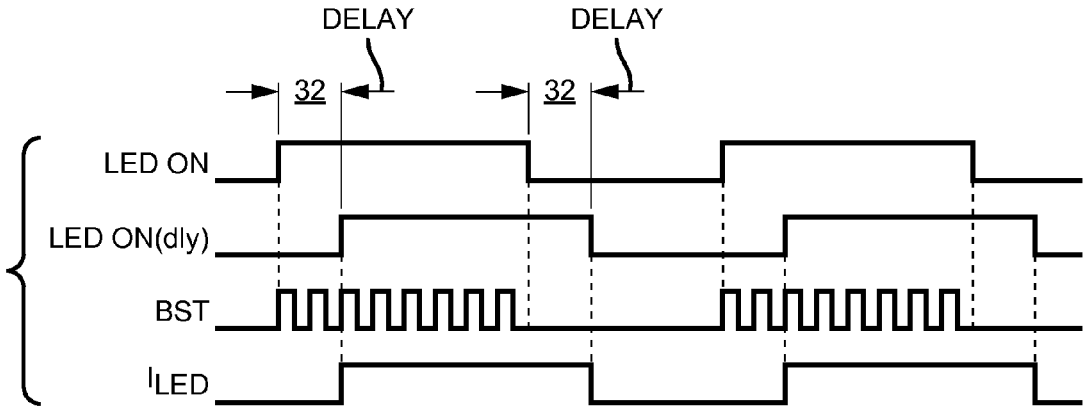
FIG. 2b
FIG. 3b
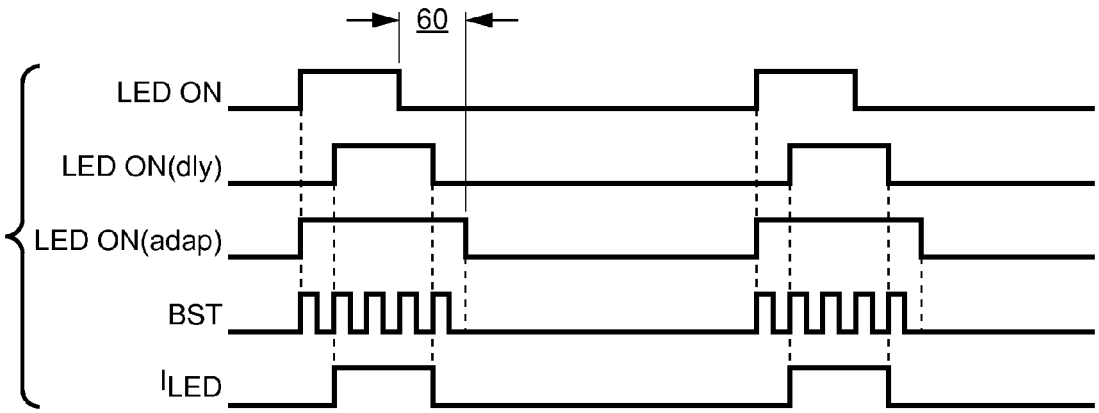

LED DRIVING SYSTEM AND METHOD

BACKGROUND OF THE INVENTION

1. Field of the Invention

This invention relates generally to systems for driving strings of LEDs, and more particularly to LED driving systems that employ a switching power converter to supply power to the LEDs.

2. Description of the Related Art

A LED is often driven by providing a DC voltage on the LED's anode terminal and an AC signal on its cathode terminal, with the AC signal operating to pulse-width modulate (PWM) the current conducted by the LED. The duty cycle of the PWM signal determines the LED's brightness. This same technique is also used to drive 'strings' of LEDs, which consist of multiple LEDs connected in series, with the cathode of one LED connected to the anode of the next LED. In this case, the DC voltage is provided to the first anode in the string, and the AC signal is provided to the last cathode in the string.

The DC voltage provided to the LEDs may be provided by, for example, a switching power converter—most typically a boost-type power converter (referred to herein as a 'boost converter', which produces an output referred to herein as a 'boost voltage'). A boost converter includes an inductor coupled to an input voltage, a switching element, an output terminal coupled to the inductor, and a controller arranged to operate the switching element so as to control the flow of current in the inductor and thereby provide a desired boost voltage at the output terminal.

Such an arrangement is shown in FIG. 1*a*. A boost converter 10 comprises an inductor L1 connected between an input voltage Vin and the anode of a diode D1, the cathode of which is connected to an output terminal 12; an output capacitor C1 is also connected to output terminal 12. A switching element S1 is connected to the node between L1 and D1, and operated by a controller 14 which receives a signal which varies with the voltage at output terminal 12 (Vout) and operates S1 (via a control signal BST) as needed to achieve a desired Vout value. A string 16 of LEDs may be connected between output terminal 12 and a switching circuit 18, which is controlled by an AC signal LED ON to pulse-width modulate the current in string 16, such that the brightness of the LEDs varies with the duty cycle of LED ON.

To conserve power in a LED driving system of the sort shown in FIG. 1*a*, the boost converter's switching element may only be actively switched when LED ON is in the state necessary to cause the LEDs in string 16 to be on. This is illustrated in the timing diagram shown in FIG. 1*b*. In this example, the LEDs are turned on when LED ON goes high, causing the current in the string ($I_{LED}$) to increase. This is also when switch control signal BST is active.

As noted above, the brightness of the LEDs is determined by the duty cycle of LED ON. However, in a system such as that shown in FIG. 1*a*, a problem can arise if the duty cycle of LED ON is too low. In this case, the number of consecutive switching cycles for signal BST will also be low. As the energy stored in L1 increases with the number of consecutive switching cycles, the relatively small number of cycles that can occur when the LED ON duty cycle is low can result in the energy being stored in L1 being insufficient to support the desired boost voltage. This causes the boost voltage to 'collapse'—i.e., be below the desired value. This effect serves to limit the minimum duty cycle for LED ON, and thereby limits the contrast ratio achievable with the LED driving system.

SUMMARY OF THE INVENTION

A LED driving system and method are presented which overcome the problems noted above, making possible a lower minimum LED duty cycle without risking boost voltage collapse.

The present driving system and method are suitable for driving one or more LEDs or strings of series-connected LEDs connected to a common output terminal. The system includes a switching power converter—typically a boost converter—having an inductor coupled to an input voltage, a switching element coupled to the inductor, and a controller arranged to operate the switching element so as to control the flow of current in the inductor and thereby provide a desired boost voltage at the common output terminal. The present system also employs a LED ON signal, coupled to the cathode ends of the LEDs or LED strings, which toggles from a first state to a second state when the LEDs are to be turned on. The boost converter is arranged such that its switching element is nominally operated only when the LED ON signal is in the second state. To control the brightness of the LEDs, the currents conducted by the LEDs are pulse-width modulated (PWM) by the LED ON signal.

Two techniques are described for making possible a lower minimum LED duty cycle without risking boost voltage collapse. The first technique employs a delay circuit, coupled to the LED ON signal such that, when the LED ON signal toggles from the first state to the second state, the LEDs are turned on a predetermined amount of time after the boost converter's switching element begins operating, such that the energy stored in the inductor when the LEDs are turned on is greater than it would be otherwise.

A second technique employs a means of detecting when the energy produced by the boost power converter is less than that required to drive the LEDs to a desired brightness due to the duty cycle of the LED ON signal being too low, and an adaptive boost operation time extension circuit arranged to respond to this condition. When the means of detecting indicates that the energy produced by the converter is less than that required to drive the LEDs to a desired brightness due to a duty cycle which is too low, the adaptive boost operation time extension circuit extends the time that the switching element is operated until after the LED ON signal toggles back to the first state, such that the energy stored in the inductor is greater than it would be otherwise. Either of these techniques may be practiced separately; in a preferred embodiment, both are employed.

These and other features, aspects, and advantages of the present invention will become better understood with reference to the following drawings, description, and claims.

BRIEF DESCRIPTION OF THE DRAWINGS

FIG. 1*a* is a block/schematic diagram of a known LED driving system.

FIG. 1*b* is a timing diagram for the LED driving system shown in FIG. 1*a*.

FIG. 2*a* is a block/schematic diagram of one possible embodiment of a LED driving system per the present invention.

FIG. 2*b* is a timing diagram for the LED driving system shown in FIG. 2*a*.

FIG. 3*b* is a timing diagram for the LED driving system shown in FIG. 3*a*.

DETAILED DESCRIPTION OF THE INVENTION

Figure 3A:
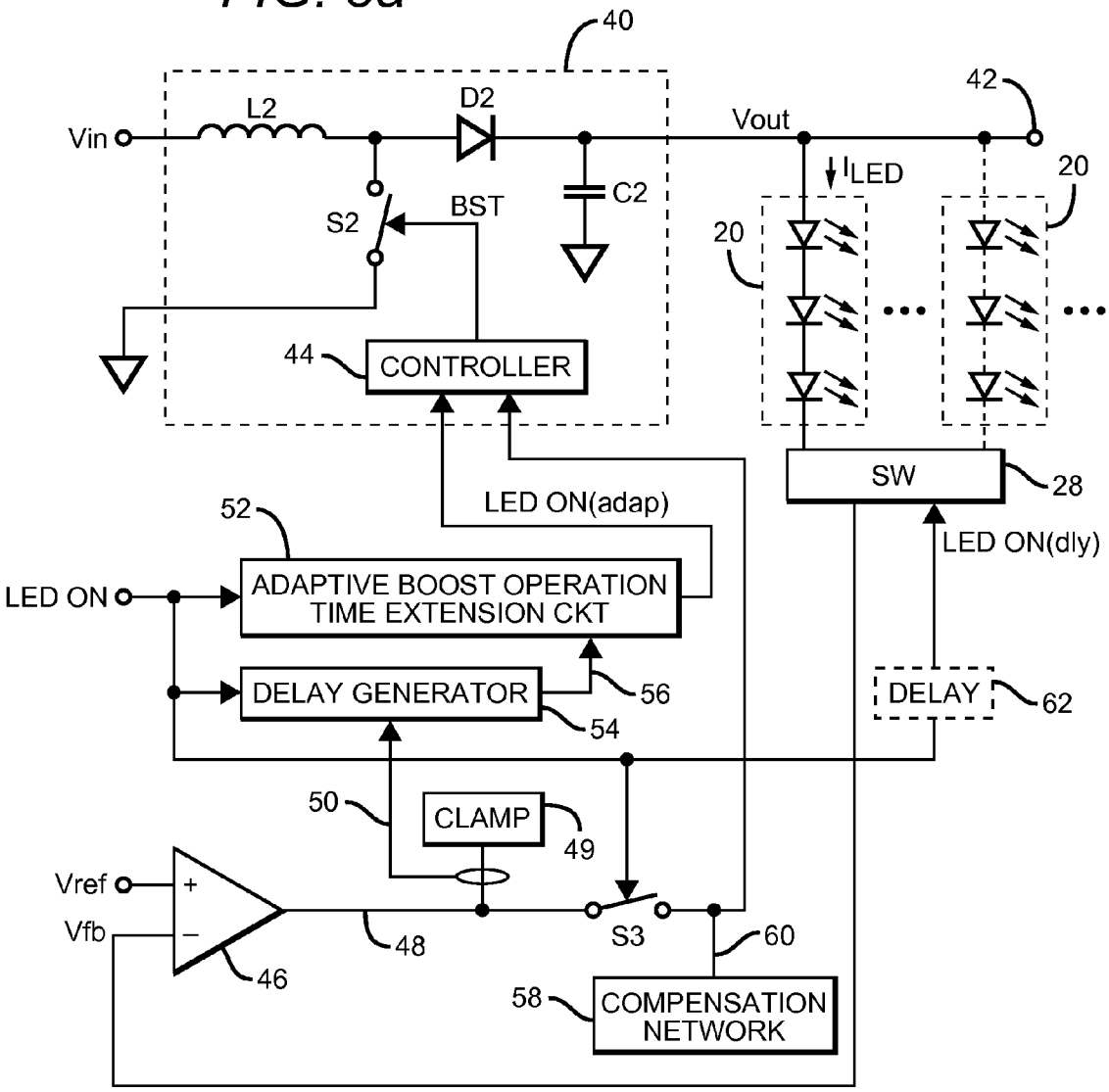
FIG. 3*a* is a block/schematic diagram of another possible embodiment of a LED driving system per the present invention.

One possible embodiment of a LED driving system per the present invention is shown in FIG. 2*a*. The system and method are suitable for driving one or more LEDs or strings of series-connected LEDs (20) connected to a common output terminal 22. The system includes a boost converter 24 having an inductor L2 coupled to an input voltage Vin, a diode D2 coupled to output terminal 22, a switching element S2 coupled to the inductor, and a controller 26 arranged to operate the switching element so as to control the flow of current in the inductor and thereby provide a desired boost voltage Vout at the common output terminal; an output capacitor C2 is also connected to the output terminal. The system receives a signal LED ON, which can come from an external or an internal source, which toggles from a first state to a second state when the LEDs coupled to output terminal 22 are to be turned on, and toggles from the second state to the first state when the LEDs are to be turned off. Note that boost-type power converters are most commonly employed in LED driving systems, and as such, a boost converter is discussed in the exemplary embodiments described herein. However, the present system is adaptable for use with any type of switching power converter.

In the exemplary embodiment shown in FIG. 2*a*, signal LED ON is coupled to a switching circuit 28, which is operated to pulse-width modulate (PWM) the current in strings 20, such that the brightness of the LEDs varies with the duty cycle of LED ON. The system is further arranged such that the switching element S2 of boost converter 24 is nominally operated (via a control signal BST) only when the LED ON signal is in its second state—i.e., when the LEDs are on.

As noted above, the brightness of LEDs 20 is determined by the duty cycle of LED ON. However, in a system such as that shown in FIG. 2*a*, a problem can arise if the duty cycle of LED ON is too low. In this case, the number of consecutive switching cycles for signal BST will also be low. As the energy stored in L2 increases with the number of consecutive switching cycles, the relatively small number of cycles that can occur when the LED ON duty cycle is low can result in the energy being stored in L2 being insufficient to support the desired boost voltage. This causes the boost voltage to 'collapse'—i.e., be below the desired value. This effect serves to limit the minimum duty cycle for LED ON, and thereby limits the contrast ratio achievable with the LED driving system.

One possible means of overcoming this problem is shown in FIG. 2*a*. A delay circuit 30 is imposed between the LED ON signal and switching circuit 28 such that, when LED ON toggles from the first state to the second state, the LEDs are turned on a predetermined amount of time after the boost converter's switching element begins operating. This has the effect of giving the boost converter a 'head start', with the result being that there will be more energy stored in inductor L2 when the LEDs are turned on (after the delay) than there would have been if there were no delay. This is illustrated in the timing diagram shown in FIG. 2*b*. In this example, the LEDs are to be turned on when LED ON goes high; note, however, that the present system can be easily adapted for use with a LED ON signal that goes low to indicate that the LEDs are to be on. Once LED ON goes high, switching signal BST becomes active, such that the energy stored in inductor L2 begins to increase. Delay circuit 30 delays the delivery of LED ON to the LEDs, outputting a signal LED ON(dly) a predetermined amount of time 32 after LED ON toggles high and BST becomes active.

When LED ON goes low, Vout is maintained by the boost converter's output capacitor C2. The delay technique described above tends to shorten the amount of time that energy is provided to the LEDs (once they are turned on) solely by capacitor C2. This tends to reduce the amount of droop, as well as the magnitude of any voltage ripple, exhibited by boost voltage Vout. One benefit of reduced ripple is that noise that might otherwise be audible—as might occur when C2 is implemented with a multilayer ceramic capacitor (MLCC)—is reduced.

Note that the LED driving system of FIG. 2*a* is preferably also arranged such that the turn off of LEDs 20 is also delayed a predetermined amount of time (such as delay time 32) after the LED ON signal toggles from the second state to the first state; this is also reflected in the timing diagram of FIG. 2*b*. When so arranged, the amount of time that the LED is turned on is substantially unchanged from a conventional arrangement with no delay imposed, and thus the brightness of the LEDs is unlikely to be significantly affected by the imposition of the turn-on delay. Though the turn-off delay occurs after BST has become inactive, there will generally be sufficient energy stored in inductor L2 to maintain Vout at a desired boost voltage until the turn-off delay expires.

Another possible means of overcoming the problem of boost voltage collapse due to a LED ON duty cycle that is too low involves extending the operation of the boost converter beyond the time it would normally cease (when LED ON toggles to indicate that the LEDs are to be turned off), so as to increase the energy stored in the inductor and thereby enable LED ON to run at a lower duty cycle without causing boost voltage collapse. However, it is not advisable to always extend the boost converter operation time regardless of the LED ON duty cycle or the loading on the boost converter output, because this might result in Vout overshoot (ripple) due to excessive energy being provided by the converter after the load has fallen to zero (when the LEDs have been turned off by LED ON).

Thus, it is preferred that the on-time of the boost converter be extended only when necessary—i.e., adaptively. This requires a means of detecting when the energy produced by the boost converter is less than that required to drive the LEDs to a desired brightness, due to the duty cycle of the LED ON signal being too low. Then, when this condition is detected, an 'adaptive' boost operation time extension circuit is arranged to extend the time that the boost converter's switching element is operated until after the LED ON signal toggles back to the first state, such that the energy stored in the boost converter's inductor is greater than it would be otherwise—thereby enabling LED ON to run at a lower duty cycle without causing boost voltage collapse. This circuit is adaptive in the sense that there is no time extension unless an extension is needed. The circuit is preferably also arranged such that the duration of the time extension varies with the magnitude of the difference between the energy produced by the boost converter and that required to drive the LEDs to a desired brightness.

One possible embodiment of a LED driving system that implements this technique is shown in FIG. 3*a*, with an accompanying timing diagram shown in FIG. 3*b*. As before, boost converter 40 includes inductor L2 coupled to Vin, diode D2 coupled to output terminal 42, and switching element S2 connected to the node between L2 and D2 and controlled (via a control signal BST) by a controller 44.

A boost converter typically includes an error amplifier as part of its output voltage regulation loop, which produces an output that increases with the difference between the desired output voltage and the actual output voltage. One way of detecting when the energy produced by the boost converter is less than that required to drive the LEDs to a desired brightness due to the duty cycle of the LED ON signal being too low is to monitor the output of such an error amplifier, as a high error amplifier output indicates a large difference between the actual and desired values of Vout. This approach is illustrated in FIG. 3*a*. An error amplifier 46 receives a signal Vfb that varies with boost voltage Vout, along with a reference voltage Vref that represents a desired boost voltage value. Error amplifier 46 produces an output 48 that increase with the difference between Vfb and Vref. A clamp circuit 49 is often used to clamp the error amplifier output when it has exceeded a predetermined threshold; thus, one way of detecting that the energy produced by the boost converter is less than that required to drive the LEDs to a desired brightness due to the duty cycle of the LED ON signal being too low is to monitor the current flowing from the error amplifier output into clamp 49. The monitoring of this current is represented in FIG. 3*a* with a signal 50.

The LED ON signal is delivered to an 'adaptive boost operation time extension' circuit 52, which produces An output LED ON(adap) that is fed to boost converter controller 44. A delay generator circuit 54 receives signal 50 from the clamp circuit, and produces an output 56 which is fed to adaptive boost operation time extension circuit 52. These circuits are arranged such that, when no current is being diverted to clamp circuit 49, which indicates that the boost voltage is not collapsing due to a low LED ON duty cycle, the output LED ON(adap) of adaptive boost operation time extension circuit 52 is essentially identical to LED ON. However, when current is being diverted to clamp circuit 49, indicating that the energy produced by boost converter 40 is less than that required to drive the LEDs to a desired brightness due to the duty cycle of the LED ON signal being too low, the output 56 of delay generator circuit 54 causes adaptive boost operation time extension circuit 52 to extend the boost operation time beyond the point at which the boost converter would normally stop operating (i.e., when LED ON toggles to indicate that the LEDs are to be turned off). The duration of the time extension is preferably proportional to the magnitude of the current flowing from the error amplifier output into clamp 49.

The output 48 of error amplifier 46 is preferably also provided to a switch S3 which is controlled by LED ON. When LED ON indicates that the LEDs are to be on, S3 is closed and error amplifier output 48 is fed to controller 44, where it is used as part of the control loop used to toggle switching signal BST and thereby regulate Vout. While S3 is closed, the voltage level of output 48 is preferably stored in a compensation network 58, which, when S3 opens (when LED ON toggles to indicate that the LEDs are to be turned off), continues to provide a voltage level approximately equal to the voltage level of output 48 to controller 44—thereby enabling the boost converter to continue regulating Vout.

The operation of a system such as that shown in FIG. 3*a* is illustrated in the timing diagram of FIG. 3*b*. While LED ON indicates that the LEDs are to be on (in this example, when LED ON goes high), the output 48 of error amplifier 46 exceeds the predetermined threshold and activates clamp circuit 49, indicating that the LED ON duty cycle is too low and the energy produced by the boost converter is less than that required to drive the LEDs to a desired brightness. As a result, delay generator 54 provides signal 56 to adaptive boost operation time extension circuit 52, such that the toggling of LED ON(adap) from high to low is extended beyond the time at which LED ON toggles from high to low. The duration of this time extension is preferably adaptive, having a length 60 which is proportional to the magnitude of the current flowing from the error amplifier output into clamp 49. This adds several switching cycles to switching signal BST, thereby enabling additional energy to be built up in inductor L2. This has the effect of enabling LED ON to run at a lower duty cycle without causing boost voltage collapse.

In a preferred embodiment, both the LED ON delay and the adaptive boost operation extension time techniques described above are employed at the same time. This is illustrated in FIG. 3*a* with the imposition of an optional delay circuit 62 between the LED ON signal and switching circuit 28; this circuit serves the same function as delay circuit 30 in FIG. 2*a*. Similarly, FIG. 3*b* includes a signal LED ON(dly), which would be delivered to switching circuit 28 if delay circuit 62 is present. Signal $I_{LED}$ will be high whenever the LEDs are on; in FIG. 3*b*, the $I_{LED}$ waveform shown assumes the use of delay circuit 62.

The embodiments of the invention described herein are exemplary and numerous modifications, variations and rearrangements can be readily envisioned to achieve substantially equivalent results, all of which are intended to be embraced within the spirit and scope of the invention as defined in the appended claims.

We claim:

1. A LED driving system for driving one or more LEDs, comprising:

a switching power converter comprising:

an inductor coupled to an input voltage;

a switching element coupled to said inductor;

an output terminal coupled to said inductor; and a controller arranged to operate said switching element so as to control the flow of current in said inductor and thereby provide a desired output voltage at said output terminal;

a LED ON signal which toggles from a first state to a second state when one or more LEDs coupled to said output terminal are to be turned on and from said second state to said first state when said LEDs are to be turned off, said switching power converter arranged such that said switching element is nominally operated only when said LED ON signal is in said second state; and a delay circuit coupled to said LED ON signal such that, when said LED ON signal toggles from said first state to said second state, said LEDs are turned on a predetermined amount of time after said switching converter's switching element begins operating, such that the energy stored in said inductor when said LEDs become turned on is greater than it would be if said LEDs were turned on prior to the predetermined amount of time.

2. The LED driving system of claim 1, wherein said delay circuit is further arranged such that said LEDs are turned off a predetermined amount of time after said LED ON signal toggles from said second state to said first state.

3. The LED driving system of claim 1, said system arranged such that, to control the brightness of said LEDs, the currents conducted by said LEDs coupled to said output terminal are pulse-width modulated by said LED ON signal.

4. The LED driving system of claim 1, wherein said one or more LEDs coupled to said output terminal comprises one or more strings of series-connected LEDs, each of which includes a plurality of LEDs, all of which are turned on in response to said LED ON signal.

5. The LED driving system of claim 1, wherein said switching power converter is a boost-type power converter.

6. A LED driving system for driving one or more strings of series-connected LEDs connected to a common output terminal, comprising:

a common output terminal adapted for connection to one or more strings of series-connected LEDs, each of which includes a plurality of LEDs, each of said strings having an anode end and a cathode end, said common output terminal connected to said anode ends;

a boost-type power converter comprising:

an inductor coupled to an input voltage;

a switching element coupled to said inductor; and a controller arranged to operate said switching element so as to control the flow of current in said inductor and thereby provide a desired boost voltage at said common output terminal;

a LED ON signal coupled to said cathode ends, said LED ON signal arranged to toggle from a first state to a second state when said LEDs coupled to said common output terminal are to be turned on and from said second state to said first state when said LEDs are to be turned off, said boost-type power converter arranged such that said switching element is nominally operated only when said LED ON signal is in said second state, said system arranged such that, to control the brightness of said LEDs, the currents conducted by said LEDs are pulse-width modulated by said LED ON signal coupled to said cathode ends; and a delay circuit coupled to said LED ON signal such that, when said LED ON signal toggles from said first state to said second state, said LEDs are turned on a predetermined amount of time after said boost-type converter's switching element begins operating, such that the energy stored in said inductor when said LEDs become turned on is greater than it would be if said LEDs were turned on prior to the predetermined amount of time, and such that said LEDs are turned off a predetermined amount of time after said LED ON signal toggles from said second state to said first state.

7. A LED driving system for driving one or more LEDs, comprising:

a switching power converter comprising:

an inductor coupled to an input voltage;

a switching element coupled to said inductor;

an output terminal coupled to said inductor; and a controller arranged to operate said switching element so as to control the flow of current in said inductor and thereby provide a desired output voltage at said output terminal;

a LED ON signal which toggles from a first state to a second state when one or more LEDs coupled to said output terminal are to be turned on and from said second state to said first state when said LEDs are to be turned off, said switching power converter arranged such that said switching element is nominally operated only when said LED ON signal is in said second state;

a means of detecting when the energy produced by said switching power converter is less than that required to drive said LEDs to a desired brightness due to the duty cycle of said LED ON signal being too low; and an adaptive boost operation time extension circuit arranged to, when said means of detecting indicates that the energy produced by said switching power converter is less than that required to drive said LEDs to a desired brightness due to the duty cycle of said LED ON signal being too low, extend the time that said switching element is operated until after said LED ON signal toggles back to said first state, such that the energy stored in said inductor is greater than it would be without extending the time that said switching element is operated.

8. The LED driving system of claim 7, wherein said adaptive boost operation time extension circuit is arranged such that the duration of said time extension varies with the magnitude of the difference between the energy produced by said switching power converter and that required to drive said LEDs to a desired brightness.

9. The LED driving system of claim 8, wherein said switching power converter includes an error amplifier which produces an output that varies with the difference between the output voltage provided at said output terminal and said desired output voltage, said adaptive boost operation time extension circuit arranged such that the duration of said time extension varies with the magnitude of said error amplifier output.

10. The LED driving system of claim 9, further comprising a clamp circuit which is activated when said error amplifier output exceeds a predetermined threshold, said adaptive boost operation time extension circuit arranged such that the duration of said time extension is proportional to the current flowing into said clamp circuit.

11. The LED driving system of claim 7, wherein said switching power converter is a boost-type power converter.

12. A LED driving system for driving one or more strings of series-connected LEDs connected to a common output terminal, comprising:

a common output terminal adapted for connection to one or more strings of series-connected LEDs, each of which includes a plurality of LEDs, each of said strings having an anode end and a cathode end, said common output terminal connected to said anode ends;

a boost-type power converter comprising:

an inductor coupled to an input voltage;

a switching element coupled to said inductor; and a controller arranged to operate said switching element so as to control the flow of current in said inductor and thereby provide a desired boost voltage at said common output terminal;

a LED ON signal coupled to said cathode ends, said LED ON signal arranged to toggle from a first state to a second state when said LEDs coupled to said common output terminal are to be turned on and from said second state to said first state when said LEDs are to be turned off, said boost-type power converter arranged such that said switching element is nominally operated only when said LED ON signal is in said second state, said system arranged such that, to control the brightness of said LEDs, the currents conducted by said LEDs are pulse-width modulated by said LED ON signal coupled to said cathode ends;

a means of detecting when the energy produced by said boost-type power converter is less than that required to drive said LEDs to a desired brightness due to the duty cycle of said LED ON signal being too low; and an adaptive boost operation time extension circuit arranged to, when said means of detecting indicates that the energy produced by said boost-type power converter is less than that required to drive said LEDs to a desired brightness due to the duty cycle of said LED ON signal being too low, extend the time that said switching element is operated until after said LED ON signal toggles back to said first state, such that the energy stored in said inductor is greater than it would be without extending the time that said switching element is operated.

13. A LED driving system for driving one or more LEDs, comprising:

a switching power converter comprising:

an inductor coupled to an input voltage;

a switching element coupled to said inductor;

an output terminal coupled to said inductor; and a controller arranged to operate said switching element so as to control the flow of current in said inductor and thereby provide a desired output voltage at said output terminal;

a LED ON signal which toggles from a first state to a second state when one or more LEDs coupled to said output terminal are to be turned on and from said second state to said first state when said LEDs are to be turned off, said switching power converter arranged such that said switching element is nominally operated only when said LED ON signal is in said second state, said system arranged such that, to control the brightness of said LEDs, the currents conducted by said LEDs are pulse-width modulated by said LED ON signal coupled to said cathode ends;

a means of detecting when the energy produced by said switching power converter is less than that required to drive said LEDs to a desired brightness due to the duty cycle of said LED ON signal being too low;

an adaptive boost operation time extension circuit arranged to, when said means of detecting indicates that the energy produced by said switching power converter is less than that required to drive said LEDs to a desired brightness due to the duty cycle of said LED ON signal being too low, extend the time that said switching element is operated until after said LED ON signal toggles back to said first state, such that the energy stored in said inductor is greater than it would be without extending the time that said switching element is operated; and a delay circuit coupled to said LED ON signal such that, when said LED ON signal toggles from said first state to said second state, said LEDs are turned on a predetermined amount of time after said switching converter's switching element begins operating, such that the energy stored in said inductor when said LEDs are turned on is greater than it would be if said LEDs were turned on prior to the predetermined amount of time.

14. A method of driving one or more LEDs, comprising:

providing a switching power converter to provide a driving voltage to one or more LEDs connected to said power converter's output terminal;

providing a LED ON signal which toggles from a first state to a second state when one or more of said LEDs coupled to said output terminal are to be turned on and from said second state to said first state when said LEDs are to be turned off, said switching power converter arranged such that it is nominally operated only when said LED ON signal is in said second state; and delaying said LED ON signal such that, when said LED ON signal toggles from said first state to said second state, said LEDs are turned on a predetermined amount of time after said switching power converter begins operating, such that the driving voltage available when said LEDs become turned on is greater than if said LEDs were turned on prior to the predetermined amount of time.

15. The method of claim 14, further comprising using said LED ON signal to pulse-width modulate the currents conducted by said LEDs.

16. The method of claim 14, wherein said one or more LEDs coupled to said output terminal comprises one or more strings of series-connected LEDs, each of which includes a plurality of LEDs, all of which are turned on in response to said LED ON signal.

17. A method of driving one or more LEDs, comprising:

providing a switching power converter to provide a driving voltage to one or more LEDs connected to said power converter's output terminal;

providing a LED ON signal which toggles from a first state to a second state when one or more of said LEDs coupled to said output terminal are to be turned on and from said second state to said first state when said LEDs are to be turned off, said switching power converter arranged such that it is nominally operated only when said LED ON signal is in said second state; and detecting when the driving voltage provided by said switching power converter is less than that required to drive said LEDs to a desired brightness due to the duty cycle of said LED ON signal being too low; and adaptively extending the operation time of said switching power converter until after said LED ON signal toggles back to said first state, such that the driving voltage provided by said switching power converter is greater than it would be without extending the operation time of said switching power converter.

18. The method of claim 17, further comprising delaying said LED ON signal such that, when said LED ON signal toggles from said first state to said second state, said LEDs are turned on a predetermined amount of time after said switching power converter begins operating, such that the driving voltage available when said LEDs become turned on is greater than it might be without extending the operation time of said switching power converter.

19. The method of claim 17, wherein said switching power converter is a boost-type power converter.

* * * * *